US008511231B2

(12) United States Patent
Hayes et al.

(10) Patent No.: US 8,511,231 B2
(45) Date of Patent: Aug. 20, 2013

(54) LESS THAN LETHAL PROJECTILE AND A METHOD FOR PRODUCING THE SAME

(75) Inventors: John Hayes, Tequesta, FL (US); Daniel Smith, Reynoldsville, PA (US)

(73) Assignee: Brejon Holdings (BVI), Ltd., Tortola (VG)

( * ) Notice: Subject to any disclaimer, the term of this patent is extended or adjusted under 35 U.S.C. 154(b) by 171 days.

(21) Appl. No.: 13/299,906

(22) Filed: Nov. 18, 2011

(65) Prior Publication Data

US 2012/0067244 A1 Mar. 22, 2012

Related U.S. Application Data

(62) Division of application No. 12/359,659, filed on Jan. 26, 2009, now Pat. No. 8,061,274.

(51) Int. Cl.

| | |
|---|---|
| ***F42B 7/02*** | (2006.01) |
| ***F42B 8/02*** | (2006.01) |
| ***F42B 8/12*** | (2006.01) |
| ***F42B 30/00*** | (2006.01) |

(52) U.S. Cl.
USPC ..... 102/502; 102/448; 102/449; 102/439

(58) Field of Classification Search
USPC ..... 102/502, 506, 439, 444, 448, 449, 102/457, 462, 529; 86/23, 25, 31, 39, 45, 86/46, 47
See application file for complete search history.

(56) References Cited

U.S. PATENT DOCUMENTS

| | | | | |
|---|---|---|---|---|
| 1,348,035 | A | 7/1920 | Mossberg | |
| 3,745,924 | A | 7/1973 | Scanlon | |
| 3,783,787 | A | 1/1974 | Thornley et al. | |
| 3,791,297 | A * | 2/1974 | McKee | 102/317 |
| 4,116,109 | A | 9/1978 | Ervine | |
| 4,422,382 | A * | 12/1983 | Marz | 102/331 |
| 5,221,809 | A | 6/1993 | Cuadros | |
| 5,450,795 | A * | 9/1995 | Adelman | 102/444 |
| 5,698,815 | A | 12/1997 | Ragner | |
| 5,831,199 | A | 11/1998 | McNulty, Jr. et al. | |
| 6,302,027 | B1 * | 10/2001 | Compton et al. | 102/323 |
| 6,374,742 | B1 * | 4/2002 | Brunn et al. | 102/502 |
| 6,655,294 | B1 | 12/2003 | Kerr | |
| 6,782,828 | B2 | 8/2004 | Widener | |
| 6,862,995 | B2 | 3/2005 | Kerr | |
| 6,899,034 | B1 | 5/2005 | Glover et al. | |
| 6,931,993 | B1 * | 8/2005 | Manole et al. | 102/458 |

(Continued)

FOREIGN PATENT DOCUMENTS

| | | |
|---|---|---|
| GB | 2062818 | 10/1979 |
| WO | WO2010085734 | 7/2010 |

*Primary Examiner* — James Bergin
(74) *Attorney, Agent, or Firm* — McHale & Slavin, P.A.

(57) ABSTRACT

A less than lethal projectile and method of producing the same comprising of a sealed filled polymeric pouch containing a shot within. The sealed filled polymeric pouch is formed in a form, fill, and seal machine. An automatic loading ammunition machine is fed empty shell casings; the ammunition machine automatically loads the empty shell casing with pre-determined quantities of wad, primer, and gun powder, and subsequently moves the sealed filled polymeric pouch into a projectile compartment of the empty shell casing producing a fully-loaded shell casing to be loaded into a barrel of an ammunition. The polymeric pouch is capable of being inserted into various shell casings depending on the intended use thus allowing for officers and soldiers to select from an array of munitions when confronted with a situation where less than lethal means are required.

17 Claims, 3 Drawing Sheets

(56) References Cited

U.S. PATENT DOCUMENTS

| | | | | |
|---|---|---|---|---|
| 7,089,864 | B2 | 8/2006 | Brunn et al. | |
| 7,204,191 | B2 | 4/2007 | Wiley et al. | |
| 7,278,357 | B2 * | 10/2007 | Keith et al. | 102/502 |
| 7,441,504 | B2 | 10/2008 | Husseini et al. | |
| 7,614,349 | B2 | 11/2009 | Puskas et al. | |
| 8,061,274 | B1 * | 11/2011 | Hayes et al. | 102/449 |
| 2001/0045173 | A1 | 11/2001 | Gibson et al. | |
| 2003/0094113 | A1 | 5/2003 | Warnagiris et al. | |
| 2003/0129138 | A1 | 7/2003 | Loghman-Adham | |
| 2004/0255813 | A1 | 12/2004 | Kerr | |
| 2005/0066841 | A1 | 3/2005 | Vasel et al. | |
| 2005/0188886 | A1 | 9/2005 | Vasel et al. | |
| 2005/0193689 | A1 | 9/2005 | Basque | |
| 2005/0229807 | A1 | 10/2005 | Brock et al. | |
| 2012/0240807 | A1 * | 9/2012 | Hayes | 102/439 |

* cited by examiner

LESS THAN LETHAL PROJECTILE AND A METHOD FOR PRODUCING THE SAME

CROSS REFERENCE TO RELATED APPLICATIONS

This application is a divisional of U.S. patent application Ser. No. 12/359,659 now U.S. Pat. No. 8,061,274, filed on Jan. 26, 2009, the contents of which is herein incorporated by reference.

FIELD OF THE INVENTION

This invention relates generally to less than lethal weapons and, more particularly, to a less than lethal projectile and a method for producing a less than lethal projectile not intended to kill and intended to minimize causalities.

BACKGROUND OF THE INVENTION

Law enforcement has long operated with what is called a "continuum of force". It provides guidance to officers for selecting the type of weaponry to use in a variety of situations. The continuum normally begins with verbal commands. Should the subject or subjects not respond, the continuum may advise the next level of force until lethal force is absolutely necessary. In situations such as riots, prisons disturbances, hostages rescues, and the like the continuum of force is utilized. However, officers have long recognized that a wide and dangerous gap exists in the range of tools available to them. In the past, officers had very few options for riot control after verbal commands. Common tactics included advancing walls of officers with batons, or a charge by officers using flats of sabers. However, these tactics still resulted in serious bodily injury due to trampling or excessive police force as they march through crowds; furthermore, innocent civilians were at times injured by inadvertent striking or trampling. It was often that the tactics used were either too weak or too strong a response to some situations. As a result the use of high-pressure fire houses, electroshock weapons, and non-lethal chemical agents (such as tear gas and offensive odor canisters) were employed to disperse a crowd. Unfortunately, the discretion of officers in utilizing these weapons and tactics led to either misuse by officers or insufficient force applied by officers to maintain peace.

While law enforcement has long recognized the gap in the force of continuum, the concept is relatively new to the military. More and more, military forces are being deployed to situations involving peacekeeping and noncombat operations. A solider must be equipped and trained for peacekeeping and humanitarian assistance operations. In certain situations, law enforcement officers and military soldiers are required to use force to control crowds or individuals, as such less than lethal means are recommended by the force continuum. Less than lethal weapons and tactics are intended to be unlikely to kill or cause great bodily injury, thus minimizing civilian casualties and providing soldiers or officers with an alternative to lethal force.

A less than lethal projectile, provided in a less than lethal weapon, assures that the requisite less than lethal consequence exists and minimizes the soldiers or officers subjectivity in determining the amount of force to use when necessary. Thus heightening the margin of safety for civilians in a riot without minimizing the primary objective: to temporarily incapacitate, confuse, delay, or restrain. One type of projectile commonly used is a beanbag. For instance, U.S. Pat. No. 6,655,294 discloses a beanbag suitable for installation in a cartridge or shell of a projectile found in a conventional handgun and the process for making the same. The beanbags are fabric bags that contain lead shot or pellets. The round is intended to flatten on impact, hitting face on, thereby spreading its energy over a larger area. When the bag leaves the gun it unrolls and rotates into the flat orientation to strike the target. Unfortunately, if the bag hits before it is completely unfurled or an edge-on orientation, the full force of the impact is distributed over a smaller area, causing more damage. Furthermore, because of their shape (square, rectangular, or circular) the bags are regarded as widely inaccurate and have been known to veer off course.

Another type of impact device launched from a cartridge shell is a less than lethal projectile. For instance, U.S. Pat. No. 7,089,864 discloses a projectile launched from a weapon shell required at impact to have a low lethality consequence, in which the projectile is fitted in the shell in a shape characterized by a blunt or flat end in the direction of flight. Unfortunately, this low lethality projectile is susceptible to being unstable during its path of flight due to its relatively low weight and slower rate of speed. Furthermore, the projectile is only capable of being fired from a 37 mm or 40 mm weapon shell thus limiting the selection of munitions available to the officer or soldier. In addition, the disadvantages associated with the low lethality projectile also include the method of producing the same. U.S. Pat. No. 6,374,742 discloses a method of shaping a projectile comprising the steps of filling an unbounded rear end of an unfilled tubular sock having a closed front end, forming folds in the tubular sock immediately forward of the rear opening, and manually inserting the tubular sock into a projectile compartment of a 37 mm or 40 mm weapon shell. In so far as the method of sealing the projectile is disclosed as a fold, it is possible that upon impact the projectile may bust, spilling the rubber pellets. Therefore a more reliable seal is desired. Additionally, the method disclosed is not conducive for mass production of the device because it cannot be manufactured on an automated production line. In point of fact, many of the steps of production in the '742 patent involve manual labor.

While these prior art devices may be suitable for the particular purpose to which they address, they would be unsuitable for the purposes of the present invention as heretofore described. As a consequence of these aforementioned problems, it is an objective of the present invention to provide a less than lethal projectile and a method of producing the same that can be easily produced and efficiently in large numbers on an automated production line.

SUMMARY OF THE INVENTION

An objective of this invention is to provide a method of producing a less than lethal projectile whereby a sealed filled polymeric pouch containing shot within. The sealed filled polymeric pouch is formed in a form, fill, and seal machine. An automatic loading ammunition machine containing empty shell casings automatically loads the empty shell casings with a pre-determined quantity of wad, primer, and gun powder, and subsequently moves the polymeric pouch into a projectile compartment of the empty shell casing thereby producing a fully-loaded shell casing adapted to be loaded into a barrel of a gun. The polymeric pouch is capable of being inserted into various shell casing depending on the intended use thus allowing for officers and soldiers to select from an array of munitions when confronted with a situation where less than lethal means are required.

Accordingly, it is a primary objective of the present invention to provide a method of producing a less than lethal projectile using a form, fill, and seal machine in combination with a loading ammunition machine. The combination will allow for a cost effective mass production assembly of the less than lethal projectile.

It is an objective of the present invention to provide a less than lethal projectile that does not kill but stuns and incapacitates.

Another objective of the present invention is to provide a less than lethal projectile containing a sealed filled pouch constructed of polymeric material which does not burst upon impact.

A further objective of the present invention is to provide a less than lethal projectile containing a polymeric sealed pouch containing non-toxic shot within. In the rare instance where the polymeric pouch is ruptured on impact or otherwise punctured, the shot therein will not harm the environment or the suspect.

Yet another objective of the present invention is to provide a less than lethal projectile whereby the polymeric pouch includes a tail on its trailing end to provide stability during flight as well a more accurate shot.

An additional objective of the present invention is to provide a less than lethal projectile that may be fired from a weapon having low pressure, such as below than 1000 psi. The speed of the less than lethal projectile will have a range between 260 and 600 feet per second.

It is a further objective of the present invention to provide a less than lethal projectile that can be used in a variety of firearms, and in particular well suited for handguns.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
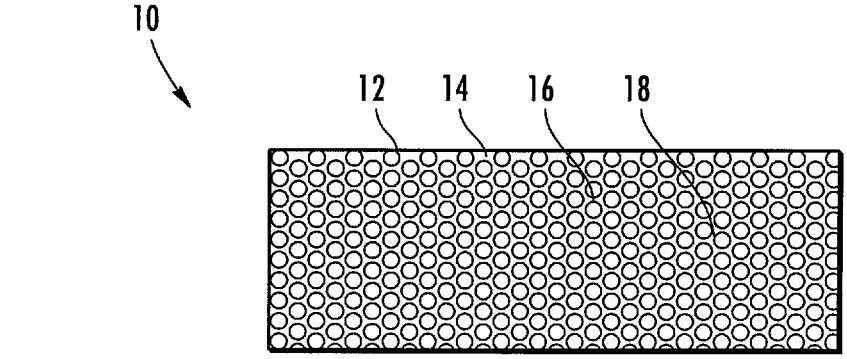
FIG. 1 is a cross sectional view of the polymeric pouch.
Figure 2:
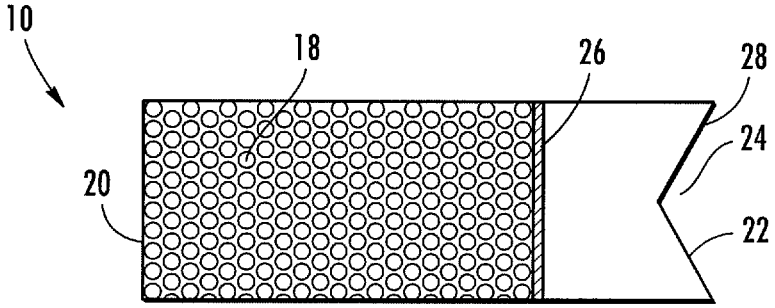
FIG. 2 is a cross sectional view of an alternative embodiment of the polymeric pouch.

Referring now to FIGS. 1-6, wherein like components are numbered consistently throughout. The less than lethal projectile 1 is constructed from a filled sealed pouch 10 and an empty shell casing 30. As shown in FIG. 1 the pouch 10 is constructed from polymeric material, more specifically, a bi-axially oriented polyethylene terephthalate polyester film (boPET). The boPET film sheet is of sufficient strength to not burst upon impact. The boPET is typically available in a variety of thicknesses, which are measured in 'mils'. The mil is not a metric unit of measure, however, one mil equals 0.001 inches. It is preferred that the boPET used is at least 4 mils. The boPET film sheet has a high tensile strength and is transparent. Although boPET is the preferred polyester film it is contemplated that other polymeric film sheet may be used in construction of the pouch 10. The pouch 10 includes an outer surface 12 and an inner surface 14 with defines a compartment 16. The compartment is filled with shot 18 of a predetermined amount of tungsten granules, a non-toxic metal. The shot 18 has a weight within the range of 260 to 437.5 grains. In the art, grain is a unit measure of weight. The shot 18 is non-toxic so that in the rare instance that the pouch 10 should burst on impact due to punctures the shot 18 within does not harm the suspect or the environment. The alternative embodiment of the pouch 10 comprises of a leading end 20 and a trialing end 22 as shown in FIG. 2. The pouch 10 includes a tail 24 on the trailing end 22. The leading end 20 having been sealed on all edges and filled with the shot 18. The leading end 20 and the trailing end 22 are not in communication with each other and include a seam 26 thereinbetween as a means of separation. The trailing end 22 comprises of a triangular notch 28 defining the tail 24.

Figure 3:
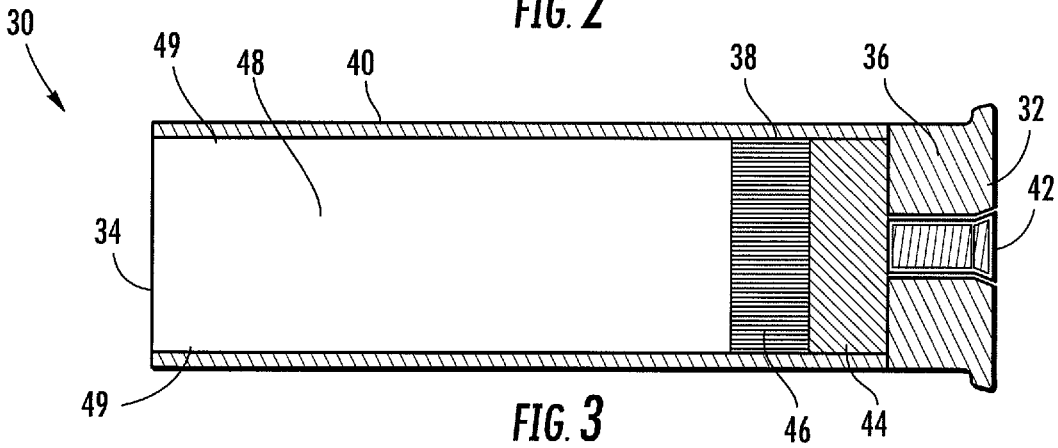
FIG. 3 is a cross sectional view of an exemplary empty shell casing.

As shown in FIG. 3, a hull 30 is provided. The hull 30 being an empty cylindrical shell having a closed end 32 and open end 34. The hull has a rim portion 36 nearest the closed end 32, a head portion 38, and a shell case portion 40 nearest the open end 34. At the rim portion 36 is primer 42. The primer 42 being nearest a firing pin on a weapon (not shown). At the head portion 38 is the gun powder 44 and the wad 46 (wadding is used in shotguns, however, in rifles and pistols there may be no need for wadding). When the firing pin strikes the primer 42, the primer 42 fires and ignites the gun powder 44. The head portion 38 may be constructed of brass, plastic, or any other suitable material. At the shell case portion 40 is located at the open end 34 of the hull 30 and includes a receiving projectile compartment 48 for a pouch 10 within its cylindrical walls 49. When the gun powder 44 ignites it builds pressure behind the wad 46 and subsequently the wad 46 and pouch 10 are propelled down the barrel of a weapon by expanding gases.

Figure 4:
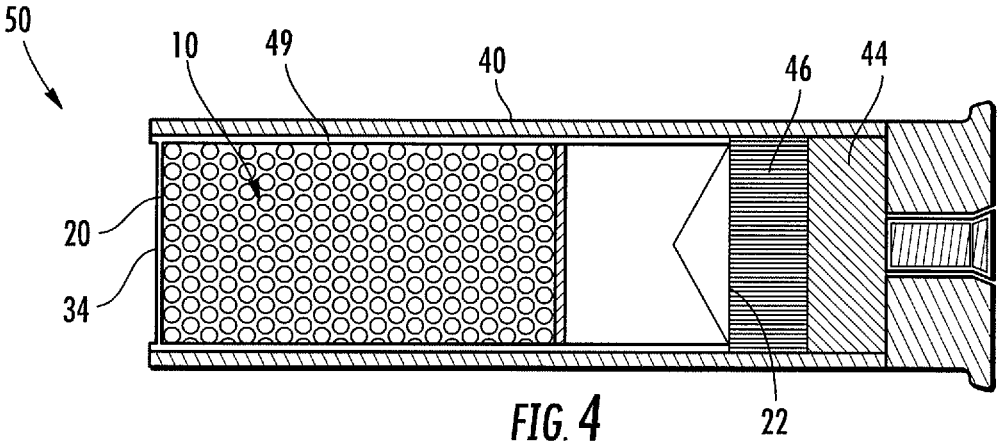
FIG. 4 is a cross sectional view of a loaded shell casing.

As shown in FIG. 4, the polymeric bag 10 is interposed within the cylindrical walls 49 of the shell case portion 40 producing a loaded shell casing 50, herein known as a less than lethal projectile. As defined a loaded shell casing 50 is ammunition consisting of a cylindrical casing containing explosive charge and a projectile, fired from a gun. The leading end 20 of the polymeric pouch 10 being nearest the open end 34 of the hull 30 at the shell case portion 40 and the trailing end 22 of the polymeric pouch 10 being adjacent to the wad 46 or gun powder 44 depending on the weapon used.

Figure 5:
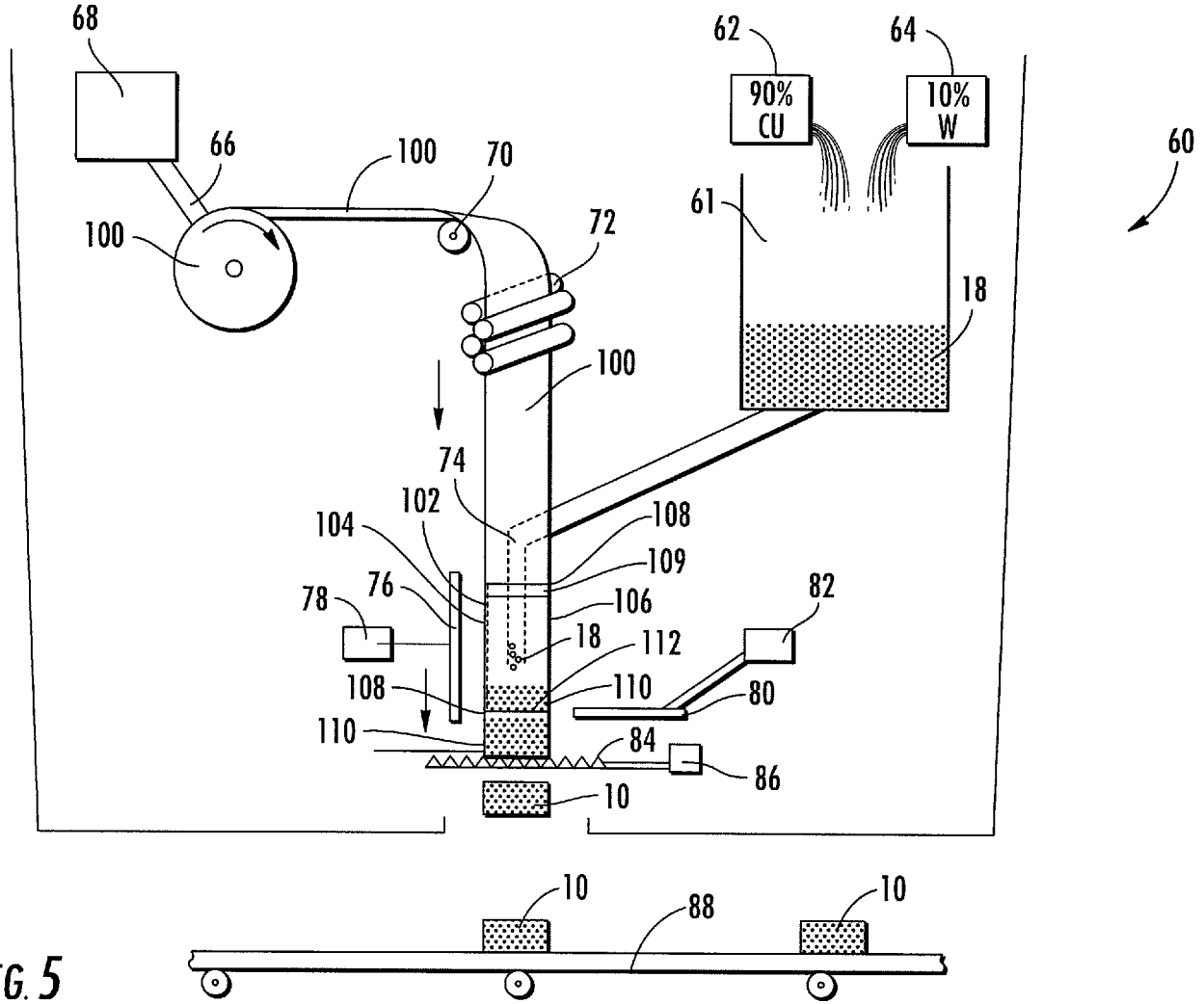
FIG. 5 is a pictorial representation of an exemplary vertical form, fill, and seal machine.

To construct the loaded shell casing 50 a vertical form, fill, and seal machine 60 is used in combination with an ammunition loading machine 90. By way of example, U.S. Publication No. 2005/0193689 is an example of a vertical form, fill, and seal machine for forming pouches with contents therein. As shown in FIG. 5, a vertical form, fill, and seal machine 60 having a hopper 61 is loaded with shot 18 having a predetermined amount of tungsten granules 64. A polymeric film sheet 100 is continuously drawn about a pouch former and filler 74 on the form, fill, and seal machine 60. More specifically, the polymeric film roll 66 has a support shaft 66 which is coupled to a drive motor 68 which rotates the polymeric film roll 100 to dispense film 100 at a predetermined rate.

Rollers 70 are placed intermittently. Furthermore, the polymeric film sheet 100 is disposed about a stationary guide roll which feeds the polymeric film sheet 100 thru a tension means 72 to maintain the polymeric film sheet 100 taut as it is fed and guided about the pouch former and filler 74. The polymeric film sheet 100 is wrapped about the pouch former and filler 74 to form an overlapped polymeric film having overlapping free edges 102. While wrapped about the pouch former and filler 74, the overlapping free edges 102 are heat sealed together with a vertical sealing bar 76 forming a vertical seal 104 and producing a hollow sleeve 106 having a top portion 108 defining an opening 109 and a bottom portion 110 defining an opening 111 between the overlapped polymeric film 100. The vertical sealing bar 76 is actuated by a piston or other suitable actuation means to position the vertical sealing bar 76 against the overlapping free edges 102 and to retract it therefrom. Then the bottom portion 110 of the hollow sleeve 106 is heat sealed by a traverse sealing bar 80 to form a traverse seam 112, the hollow sleeve 106 is then filled from the top portion opening 109 with shot 18 from the pouch former and filler 74. Concurrently therewith the top portion 108 of the filled hollow sleeve 106 is heat sealed by a traverse sealing bar 80 and detached from the bottom portion 110 of another pouch (which is concurrently about to be filled) with a sealing jaw 84 producing a filled sealed polymeric pouch 10. The traverse sealing bar 80 is actuated by a piston or other suitable actuation means 82 to position the traverse sealing bar 80 against the top portion 108 and bottom portion 110 of the hollow sleeve 106 and to retract it therefrom. The sealing jaw 84 is also actuated by a piston or other suitable actuation means 86. Once detached the filled sealed pouch 10 is fed onto a conveyor 88. The heating means forming seams on the polymeric film sheet is a resistive heating element having a temperature control. The vertical form, fill, and seal machine allows for change in the size of the pouch and a different grain weight for shot. The conveyor 88 feeds the filled sealed pouch 10 through a collator station 89 that properly positions the pouch 10 in the correct orientation to be loaded onto an ammunition loading machine 90. The collator station 89 is a device for placing the pouch 10 in an orientation suitable for entering the ammunition loading machine 90. It is contemplated that the collator station 89 positions the pouch 10 with the tail end 24 leading to enter the ammunition loading machine 90 for tail first loading within the empty shell casing 30.

Figure 6:
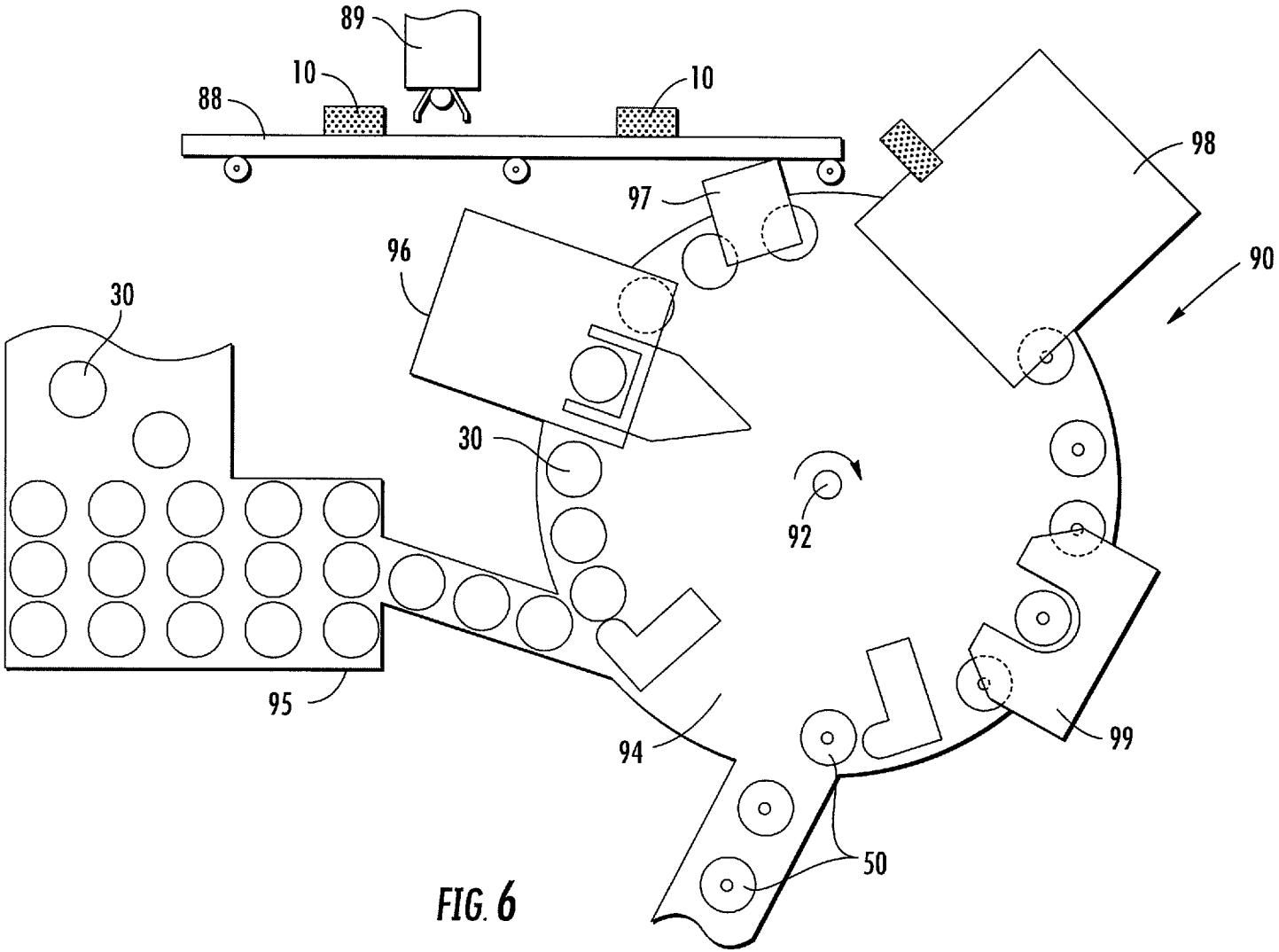
FIG. 6 is a pictorial representation of an exemplary ammunition loading machine.

U.S. Pat. No. 4,116,109 is an example of an ammunition loading machine. As shown in FIG. 6, the ammunition loading machine 90 is fed empty shell casings 30, herein known as hulls. A drive chassis 92 which operates a dial 94 about an axis, transport the hulls 30 successively to a series of circumferentially-spaced loading stations, such as the hull loading station 95, wad and powder filler 96, the shot charger 97, shot feeder 98, and the crimping fixture 99. The empty shell casings 30 are automatically loaded with a pre-determined quantity of wad and gun powder. The pre-determined amount of wad, primer, and gun powder is dependent on the intended use of the less than lethal projectile. As a less than lethal projectile firing from a weapon with low pressure may contain more wad or gun powder than a less than lethal projectile firing from a weapon with high pressure. Then the filled sealed pouch 10 is automatically moved into the projectile compartment 48 of the empty shell casing 30. The filled sealed pouch 10 is loaded with the tail end 24 adjacent to the wad 46, for tail first loading. Lastly, the projectile compartment 48 is crimped to producing a fully-loaded shell casing 50, herein known as a less than lethal projectile, adapted to be loaded into a barrel of a firearm. The automatic loading ammunition machine can be loaded with various caliber shell casings and various lengths for shell casing. Furthermore, the automatic loading ammunition machine allows for varying the amount of gun powder and wad in a shell casing.

The less than lethal projectile 50 is capable of being fired from a weapon of low pressure, specifically a weapon having a chamber pressure as low as 600-700 psi. Because of the ability of the less than lethal projectile to be fired at an extremely low pressure the less than lethal projectile can be adapted to be fired from any handgun of any size or caliber. Preferably, the firearm used to discharge the less than lethal projectile comprises of a stationary barrel with a plurality of bores with a revolving firing pin. By way of example U.S. Pat. No. 1,348,035 disclosed such a device. However, it should be noted that the less than lethal projectile is not limited to this type of firearm. It is also contemplated that a rail may be positioned on the firearm. The rail is equipped with a light source of up to 120 lumens, this amount of light may temporarily blind the suspect and provide increase safety to the user. The rail is also equipped with a laser. The laser capability provides a beam of light towards the intended target. The laser capability allows the user better accurate in firing the firearm. The rail further including a video and audio camera for documentation of the foregoing events.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A filled seal pouch for a less than lethal projectile comprising:

a sealed pouch comprising a less than lethal projectile constructed of a bi-axially oriented polyethylene terephthalate polyester film, said pouch further including an outer surface and an inner surface defining a compartment; and said compartment containing a predetermined amount of tungsten granules;

wherein said pouch is adapted for installation within a ammunition shell casing consisting of a less than lethal projectile.

2. A filled seal pouch for a less than lethal projectile according to claim 1, wherein said polymeric film is of sufficient strength so as to not burst upon impact.

3. A filled seal pouch for a less than lethal projectile according to claim 1, wherein said predetermined amount of tungsten granules has a weight of approximately within the range of 260 to 437.5 grain.

4. A filled seal pouch for a less than lethal projectile according to claim 1, wherein said pouch further includes a leading end including said compartment and a trailing end defining a tail.

5. A filled seal pouch for a less than lethal projectile according to claim 4, wherein said trailing end is formed of polymeric material and is separate from said leading portion.

6. A filled seal pouch for a less than lethal projectile according to claim 5, wherein said tail comprising of a triangular notch cut out.

7. A less than lethal projectile comprising:

a sealed filled pouch constructed of a bi-axially oriented polyethylene terephthalate polyester film, said sealed pouch further including an outer surface and an inner surface defining a compartment;

said compartment having a predetermined amount of tungsten granules; and a shell casing for housing a less than lethal projectile having an open end and a closed end, said shell casing including a rim portion, a head portion, and a shell case portion, said rim portion forming the closed end of said less than lethal projectile and having a primer element within, said shell case portion positioned within the open end of said less than lethal projectile containing a projectile compartment and having said sealed pouch installed within, and said head portion juxtaposed said rim portion and having a pre-determined amount of wad and gun powder within.

8. A less than lethal projectile according to claim 7, wherein said polymeric material is of sufficient strength to not burst upon impact.

9. A less than lethal projectile according to claim 7, wherein said sealed filled pouch further includes a leading end including said compartment and a trailing end defining a tail.

10. A less than lethal projectile according to claim 9, wherein said trailing end is formed of sufficient length of said polymeric material and is separate from said leading portion.

11. A less than lethal projectile according to claim 9, wherein said tail comprises of a triangular notch cut out.

12. A less than lethal projectile according to claim 11, wherein said tail provides stability in flight to said less than lethal projectile once fired.

13. A less than lethal projectile according to claim 7, wherein said predetermined amount of tungsten granules has a weight of approximately within the range of 260 to 437.5 grain.

14. A less than lethal projectile according to claim 7, wherein said less than lethal projectile is capable of being fired from said shell casing at a low pressure from a muzzle.

15. A less than lethal projectile according to claim 14, wherein said low pressure measuring less than 1000 psi.

16. A less than lethal projectile according to claim 15, wherein said low pressure measuring within the range of 600 to 700 psi.

17. A less than lethal projectile according to claim 16, wherein said less than lethal projectile has a velocity when exiting said muzzle is approximately within the range of 260 to 600 feet per second.

* * * * *